United States Patent [19]

Badgley et al.

[11] 4,448,169

[45] May 15, 1984

[54] INJECTOR FOR DIESEL ENGINE

[75] Inventors: Patrick R. Badgley, Glen Rock, N.J.; Andrew C. Rosselli, Columbus, Ind.

[73] Assignee: Cummins Engine Company, Inc., Columbus, Ind.

[21] Appl. No.: 221,764

[22] Filed: Dec. 31, 1980

[51] Int. Cl.[3] ..... F02M 39/00

[52] U.S. Cl. ..... 123/467; 123/501; 123/477; 239/89

[58] Field of Search ..... 123/467, 499, 500, 501, 123/502, 477; 239/89, 90, 91, 92, 93, 94, 95, 533.1, 533.15

[56] References Cited

U.S. PATENT DOCUMENTS

| | | | |
|---|---|---|---|
| 1,804,413 | 5/1931 | Groff | 123/ |
| 3,465,737 | 9/1969 | Dreisin | 123/502 |
| 3,689,205 | 9/1972 | Links | 123/ |
| 3,837,324 | 9/1974 | Links | 123/ |
| 3,921,604 | 11/1975 | Links | 123/ |
| 3,943,901 | 3/1976 | Takashashi | 123/ |
| 3,961,612 | 6/1976 | Okamoto | 123/ |
| 4,046,112 | 9/1977 | Deckard | 123/ |
| 4,069,800 | 1/1978 | Kanda | 123/447 |
| 4,271,807 | 6/1981 | Links | 123/467 |

*Primary Examiner*—Charles J. Myhre
*Assistant Examiner*—Carl Stuart Miller
*Attorney, Agent, or Firm*—Neuman, Williams, Anderson & Olson

[57] ABSTRACT

An injector for a diesel engine is provided which includes a housing having an internal bore, and a reciprocating plunger disposed within the bore and coacting therewith to pump fuel, dampen plunger movement, and quickly vent fuel pressure to provide a sharp end of injection. The bore is generally coextensive with the housing and a spray tip is attached to the end of the bore to introduce fuel into a combustion chamber. The plunger forms a chamber at the end of the bore that expands to admit fuel and contracts to express fuel as the plunger reciprocates within the bore. The chamber has an upper portion that pumps fuel and a lower sealable portion that entraps fuel to dampen plunger movement. The plunger and bore also form a reciprocating spill valve above the chamber to vent fuel pressure. An internal inlet passage supplies fuel to the pumping chamber portion. An internal spray passage connects the pumping chamber portion to the spray tip. The spill valve communicates with the chamber. An internal relief passage connects the spill valve to an exit port.

7 Claims, 2 Drawing Figures

INJECTOR FOR DIESEL ENGINE

BACKGROUND OF THE INVENTION

This invention relates generally to fuel injection systems for internal combustion (diesel) engines, and more particularly to injectors that introduce the fuel into the combustion chambers of the engine. The injector disclosed herein is suitable for use with an injection system that is actuated mechanically, hydraulically, electrically, or with a hybrid of any of the foregoing.

In recent years there has been renewed interest and impetus to develop more efficient internal combustion engines that also produce lower levels of emissions or other environmentally undesirable byproducts. It has been determined that these objectives may be accomplished in part by altering the timing of fuel injection with respect to piston or crankshaft position, and by obtaining a high injection pressure, short injection duration, variable injection duration, and a sharp end of injection with no leakage or secondary injection.

Efforts to achieve these objectives with conventional camshaft driven injectors have not met all of these objectives because of the inherent restraints of a mechanical system. Most noteably, the combination of camshaft, push rods, rocker arms, etc. usually results in a rigid timing program that cannot be altered. Efforts to advance or retard injection timing have included hydraulically expandable tappets to lengthen or shorten a camshaft drive train. Such tappets have met with some success, but have not permitted alteration of the other injection parameters affecting engine performance.

As a result, manufacturers have experimented with other means to activate fuel injectors, including electrical systems, hydraulic systems, and systems that are a hybrid of both. These systems result in the application and removal of great, yet precise, amounts of force almost instantaneously, in order to achieve the desired injection characteristics yet not damage the injector itself. Thus, the diesel injector must not only inject the fuel in accordance with the aforementioned objectives, it must also withstand the instantaneous pressures applied thereto.

SUMMARY OF THE INVENTION

It is an object of the present invention to overcome the aforementioned difficulties and short-comings of the prior systems for selectively varying the timing and various other characteristics of fuel injection.

Another object of the invention is to provide a novel, reliable and simple diesel injector that is compatible with electrical, hydraulic, mechanical and hybrid injection systems.

Still another object of the invention is to provide an injector with improved injection characteristics, thereby enhancing the efficiency and power output of an engine as well as lowering undesirable emissions.

These and other objects are obtained by providing an injector for a diesel engine wherein the injector includes a housing and a spray tip. The housing is provided with a bore having an inlet connected to a fuel source and an outlet connected to a fuel return. A reciprocating plunger is disposed within the bore and coacts therewith to form a chamber that expands and contracts to admit and express fuel. The upper portion of the chamber pumps the fuel and the lower portion traps fuel to dampen plunger movement. The plunger and bore also form a spill valve above the chamber that reciprocates with the plunger. Internal passages connect the inlet port to the chamber, and the upper portion of the chamber to the spray tip. The spill valve communicates with the chamber. An internal relief passage connects the spill valve to an exit port and sharply and precisely ends injection when the pressure in the spray tip means collapses.

DESCRIPTION OF THE DRAWINGS

All of the above is more fully explained in the detailed description of the preferred form of the invention which follows. This description is illustrated by the accompanying drawings wherein.

DESCRIPTION OF THE PREFERRED EMBODIMENT

While a specific preferred embodiment is disclosed herein, oriented in a preferred direction, it is understood that variations in configuration and orientation are within the scope of the present invention.

Figure 1:
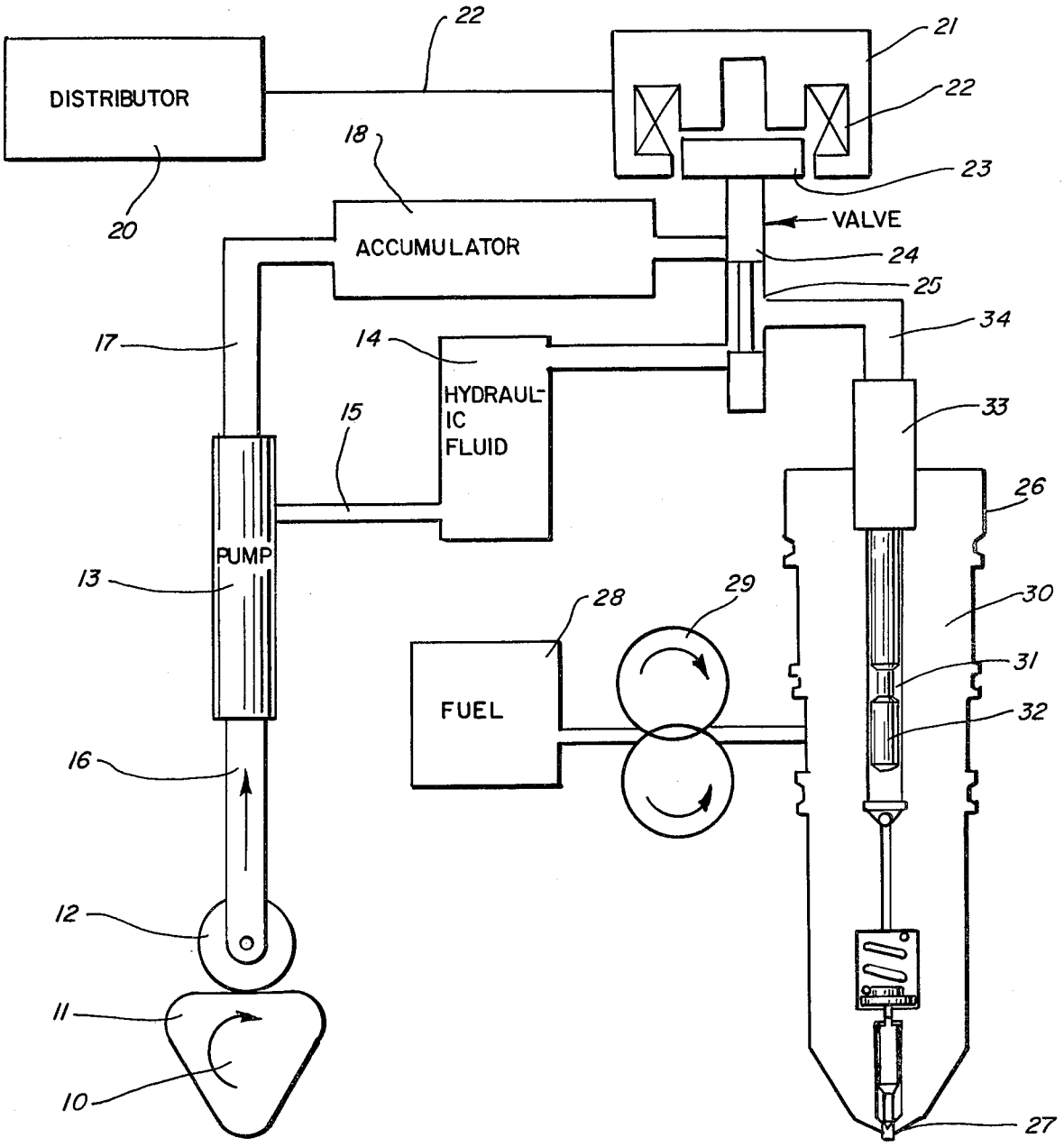
FIG. 1 is a fragmentary non-scale schematic illustration of an electrical hydraulic fuel injection system illustrating the use of one form of the instant invention.

Referring to FIG. 1, an electrical hydraulic injection system is shown for a diesel engine. The detailed operation of this system is not necessary to an understanding of the present invention, but it is being supplied to assist in an understanding of the environment in which applicant's novel injector operates. Thus, both major and minor modifications or alterations may be made in the system or its components without affecting applicant's invention.

A camshaft 10 is typically mounted for rotational movement in an engine block (not shown). The camshaft has a selected number of eccentric lobes 11 around its periphery in predetermined timed rotational relationship to one another. The camshaft may be connected to an engine crankshaft (not shown) by any conventional timing means so as to maintain the two in a fixed timed relationship and coordinate, if necessary or desirable, the rotation of the camshaft and crankshaft. A camshaft follower 12 bears against the camshaft lobes and is in rolling contact therewith to translate the rotational camshaft motion into reciprocal motion.

A hydraulic pump 13 is supplied hydraulic fluid from a suitable reservoir 14 via connecting line 15. Energy to operate the pump is supplied via push rod 16 operatively connecting the pump 13 and cam follower 12. Pressurized hydraulic fluid (on the order of 10,000 p.s.i.) is supplied via line 17 to an accumulator 18 that maintains a predetermined fluid pressure level for the hydraulic system.

A distributor mode 20, which typically includes electronic circuitry, monitors any number of engine, environmental, and load characteristics, which it considers to control fuel injection. For instance, it may monitor engine temperature, speed, manifold pressures, fuel flow, load conditions, throttle settings, etc., and adjust the timing, duration or other characteristics of fuel injection.

An electrically controlled valve means 21 is operatively connected to the distributor 20 by an appropriate conductor means 22. The valve 21 may be electromagnetically controlled by solenoid windings 22 acting upon a valve control stem 23. The valve body may be a spool valve comprising a cylindrical stem 24 having a predetermined number of axially spaced diameters disposed for reciprocal sealing movement within a valve bore 25. This valve should be capable of rapid changes to quickly apply or vent the very high pressure hydraulic fluid from the accumulator.

A fuel injector 26 is disposed in the engine block (not shown) with its cup 27 protruding into the cylinder combustion chamber (not shown) to supply the desired amount of fuel in an appropriate pattern at an appropriate time. Fuel is supplied from a suitable reservoir 28 to the injector by a conventional fuel pump 29 interposed therebetween. The means of supplying the fuel may be varied as necessary or desirable to provide an appropriate flow rate, fluid pressure, flow volume, etc. The injector (described in more detail hereinafter in connection with FIG. 2) includes an elongated housing 30 having a primary bore 31 generally coextensive with the housing. A plunger 32 is disposed in said bore for reciprocal movement and is operatively connected to a hydraulic fluid actuator 33 that converts changes in hydraulic pressure into reciprocal movement. In response to an appropriate signal from the distributor 20, valve 24 connects the accumulator 18 to the actuator 33 via the connecting line 34, applying hydraulic pressure to activate the actuator and depress the injector plunger 32. The actuator 33 and plunger 32 remain in their depressed position until the distributor 20 signals the valve 24 to shift and seal off the passageway from the accumulator 18 to the actuator 33 and simultaneously open the passageway from the actuator 33 to the hydraulic fluid reservoir 14, thereby venting the hydraulic pressure at the actuator. As the pressure is vented, the injector plunger retracts.

Figure 2:
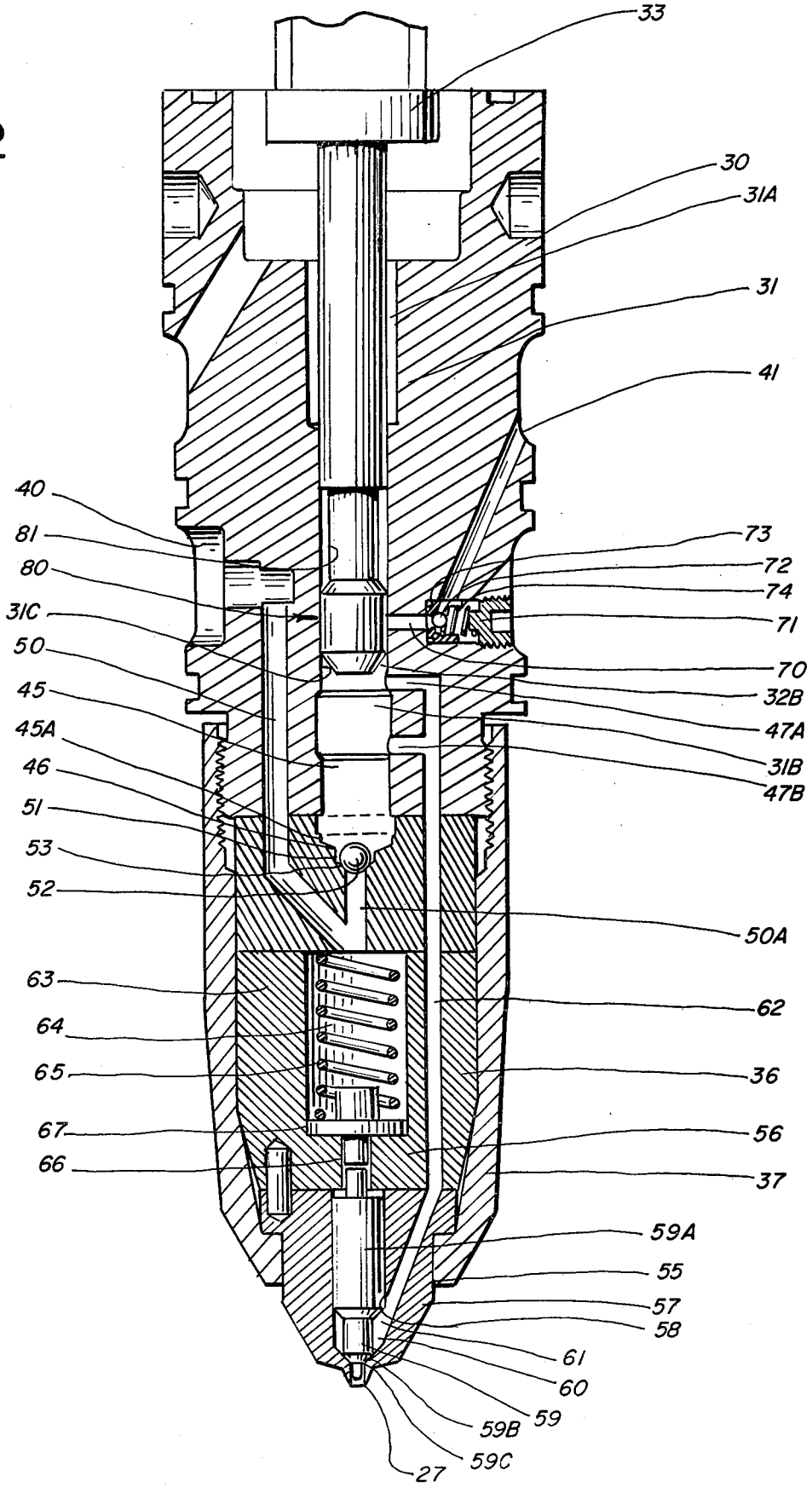
FIG. 2 is an enlarged fragmentary vertical cross sectional view of one embodiment of the fuel injector of the present invention shown in a metering mode.

As seen in FIG. 2, the elongated housing 30 of the injector has a spray tip assembly 36 mounted near the cup end thereof. The injector may be attached to the engine block or cylinder head (neither are shown) in any conventional manner, provided that the spray cup 27 is disposed within the cylinder combustion chamber. The primary housing bore 31 is preferably cylindrical and plunger 32 moves therein from a retracted position (shown in FIG. 2) to a depressed position where it is disposed down into the bore to the fullest extent. The spray tip assembly 36 is disposed at the lower end of the bore 31 and is connected thereto by any suitable means, such as a jacket 37 that surrounds the spray tip and fixedly retains it against the housing.

The housing 30 includes an inlet port 40 connected to the pressurized source of diesel fuel, such as the fuel reservoir 28 and pump 29 of FIG. 1. Housing 30 is also provided with an exit port 41 for connection to a suitable diesel fuel return that recirculates excess fuel back to the fuel reservoir 28. The inlet and exit ports may be located as is convenient. Primary bore 31 is open at its upper portion 31A while the lower portion 31B is proximate the spray tip assembly 36.

Reciprocating plunger 32 has a first, or upper, end 32A operatively connected to the actuator 33, which controls axial plunger movement and a second, or pumping, end 32B which is disposed in a sliding sealing engagement within the lower portion 31B of bore 31. The plunger end 32B coacts with bore portion 31B to define a fluid tight chamber 45 having an inlet 46 formed adjacent the bottom 45A thereof. The location of the inlet 46 within the chamber may be altered as desired provided the flow into the chamber is not throttled when the plunger 32 is in its retracted position. Chamber 45 also is provided with upper and lower outlets 47A, 47B spaced axially apart a predetermined distance and disposed mediate the chamber bottom portion 45A and the second plunger end 32B when the plunger is in its raised position. Axial variations in the chamber outlet locations will alter the amount of fuel injected and the degree of dampening the plunger movement, as described in more detail hereafter.

An internal inlet passage 50 is formed in housing 30 and connects the inlet port 40 to the chamber inlet 46 via a passage 50A formed at the bottom portion 45A. An inlet check valve 51, including a ball 52 and mating seat 53 is disposed within passage 50A at the juncture thereof with chamber 45 and insures that fuel flow in the passage is unidirectional from the inlet port 40 into the chamber 45. Ball 52 is biased towards seat 53 by gravity and is unseated when the force on the ball from the pressure in passage 50A exceeds the combined forces on the ball from gravity and the pressure within the chamber 45. Any configuration valve permitting unidirectional flow is suitable, and it may include bias means as necessary or desirable.

The spray tip assembly 36 includes a spray valve control element 56, positioned adjacent the bottom of housing 30, and a spray valve piece 55 depending from the control element 56. As aforementioned, spray tip assembly 36 is secured by any suitable means to housing 30 by jacket 37.

The spray valve piece 55 comprises a valve body 57 having an internal bore 58 substantially coextensive therewith. The spray cup 27 is disposed at the tip of the body 57 and is in communication with bore 58. Cup 27 has one or more ports to dispense fuel in a predetermined pattern into the cylinder combustion chamber (not shown). A nozzle valve stem 59 is mounted for reciprocal movement within bore 58 and coacts therewith to define a spray nozzle chamber 60 at the lower end of the bore 58 and adjacent the spray cup 27. The stem 59 has an upper first diameter segment 59A forming a fluid-tight seal with bore 58, a second smaller diameter segment 59B disposed within chamber 60, and a lower tapered segment 59C proximate the cup 27. Segment 59C sealingly seats against the bottom of the nozzle chamber 60 and prevents exit flow from the nozzle chamber 60 to the spray cup 27 when the plunger 59 is in its lowermost position. Nozzle chamber 60 also includes an inlet port 61 that is connected to the chamber outlets 47A, 47B by internal spray passage 62.

The spray valve control element 56 includes a control body 63 defining an internal valve spring chamber 64 containing an expansion spring 65 or other bias means. Slidably disposed within a port 66 communicating spring chamber 64 and nozzle bore 58, is a link 67 which operatively connects spring 65 to nozzle valve stem 59, urging the latter downwardly so that stem segment 59C is seated against cup 27. Stem 59 unseats when the force of the fluid pressure in the nozzle chamber 60 acting on the differential area of first diameter segment 59A less the second diameter segment 59B overcomes the force of valve spring 65 and the inertia of the valve stem 59, link 67, and spring 65. Stem segment 59C will remain unseated as long as the fluid pressure in the nozzle chamber 60 remains above a predetermined minimum level.

An internal relief passage 70, disposed axially above the chamber outlets 47A, 47B, connects housing bore 31 and exit port 41 via an exit check valve 71. The exit check valve includes a ball 72, mating seat 73 and bias means 74 to seat the ball, and thus, insures unidirectional fuel flow in the passage 70 from the bore 31 to the exit port 41. The exit check valve 71 may be of any suitable alternate configuration.

A spool type spill valve 80 is disposed above the chamber 45 and is formed by a portion 31C of bore 31 mediate the upper and lower portions 31A and 31B, and an annular groove 81 formed in the exterior of the plunger 32 mediate said first end segment 32A and second end segment 32B. When the valve 80 is open it connects the spray nozzle chamber 60 to the exit port 41 via the relief passage 70 and the spray passage 62, which permits bidirectional flow. The axial distance between the plunger 32B and the lower portion of groove 81 is the same as the axial distance between the two chamber outlets 47A, 47B. Thus, when plunger 31 has been depressed so that its segment 32B closes off lower outlet 47B, groove 81 will span the distance between the upper chamber outlet 47A and relief passage 70, permitting fluid flow therebetween.

In operation, when the injector is in its metering cycle, the plunger 32 and actuator 33 are both in their fully retracted positions, as shown in FIG. 2, and chamber 45 is at maximum volume. When this occurs, relief passage 70 is sealed by the plunger segment 32B of the spill valve 80. Fuel is supplied at a relatively low pressure to the inlet port 40 and flows through the inlet passage 50. The pressure of the fuel against the ball 52 creates a force sufficient to unseat the ball and allow the fuel to fill chamber 45. The nozzle valve stem 59, however, remains seated as this occurs thereby sealing chamber 60 from the spray cup 27, because the force generated by the low fueling pressure is insufficient to overcome the bias of spring 65.

During the injection stage, actuator 33 is energized depressing plunger 32 with great force. This downward movement of the plunger into the chamber 45 significantly and drastically increases the fuel pressure within chamber 45. This latter pressure creates a force closing the inlet check valve 51 and increases the pressure in the spray passage 62, inlet port 61, and nozzle chamber 60. The fuel pressure in the nozzle chamber acts upon the differential area of the valve stem 59 to overcome the force of valve spring 65 and the valve inertia. The high pressure fuel is then forced to the spray cup 27 and is injected into the combustion chamber. Injection continues as the plunger moves downward towards the bottom of the chamber forcing fuel out of the chamber via the lower chamber outlet 47B. Outlet 47A is sealed by the segment 32B of the plunger.

Just as plunger segment 32B seals the lower chamber outlet 47B, the spill groove 81 connects the upper chamber outlet 47A with the relief passage 70, causing a rapid collapse of the fuel pressure in the spray passage 62 and nozzle chamber 60 as the fuel flow reverses and exits via exit check valve 71. As a result the nozzle valve stem rapidly closes under the bias of the valve spring 65, providing a clean and sharp end of injection with no dribble.

Due to the extremely high force applied to the plunger 32 by the accumulator-actuator combination, the plunger achieves an extraordinarily high velocity which is difficult to arrest. To solve this problem, the chamber outlets 47A, 47B are placed above the chamber bottom 45A, thereby creating a fluid reservoir which acts as a hydraulic stop while still allowing the fuel pressure in the spray nozzle chamber 60 to rapidly collapse and sharply end injection. Following the end of injection, the plunger returns to its extended position, permitting the cycle to repeat as fuel is again metered into the chamber 45.

With the benefits of applicants' disclosure, it is apparent that substitutions and modifications may be made to vary the configuration of the housing, plunger and spray tip. However, each of these changes are included within the scope of the invention.

What is claimed is:

1. An injector to introduce fuel into the cylinder of a diesel engine, said injector comprising an elongated housing having a spray tip means at one end thereof for introducing fuel into a combustion chamber formed in the cylinder, said housing including an inlet port for connection to a pressurized source of diesel fuel, an exit port for connection to a diesel fuel return, and a primary axial bore having a generally uniform diameter, said bore selectively communicating with said inlet and exit ports and having first and second portions with said first portion being proximate said spray tip means, a plunger axially movable within said bore and operatively connected to reciprocating means to selectively withdraw and depress said plunger, said plunger and bore coacting to form a fluid-tight chamber in the first portion of said primary bore, said chamber expanding to admit fuel supplied via said inlet port when said plunger is at least partially withdrawn, and partially contracting to expel therefrom a predetermined amount of the admitted fuel when said plunger is at least partially depresssed, the expelled fuel amount being pumped by the plunger from an upper section of the chamber to said spray tip means via a first passage formed in said housing, the remainder of the admitted fuel being entrapped and continuously maintained within a lower sealable section of the chamber to dampen plunger movement into said chamber; a spill valve means selectively communicating with said chamber, and operating in conjunction with the reciprocating of said plunger; and an internal second passage formed in said housing and connecting said spill valve to said exit port, so that when said plunger is in a predetermined depressed position within said bore effecting communication between said spray tip means and said exit port via said first passage and said spill valve, the pressure in said spray tip means collapses to sharply end injection while said chamber lower section remains sealed to dampen plunger movement.

2. The injector of claim 1 wherein said spray tip means includes an internal nozzle chamber having an inlet connected to said first passage, one or more outlets for expelling fuel into the combustion chamber, exit valve means interposed between said chamber and said outlet for opening or sealing said chamber, said exit valve means being biased to releasably retain said valve means in a closed position provided the pressure within said nozzle chamber does not exceed a predetermined level.

3. The injector of claim 1 wherein said inlet port communicates with an inlet check valve that opens to permit fuel to enter said chamber and closes to prevent fuel from escaping said chamber.

4. The injector of claim 1 wherein said second passage includes an outlet check valve that opens to permit fuel to exit said first passage and closes to prevent fuel from entering said first passage via said exit port.

5. The injector of claim 1 wherein said spill valve means includes an annular groove formed in the exterior of said plunger.

6. The injector of claim 1 wherein said reciprocating means includes a hydraulic accumulator.

7. The injector of claim 1 wherein said reciprocating means includes an electrically actuated solenoid valve.

* * * * *